US011679905B1

(12) United States Patent
Ellis

(10) Patent No.: US 11,679,905 B1
(45) Date of Patent: Jun. 20, 2023

(54) UPPER STABILIZING TRAY FOR FILLING CARTRIDGES AND RELATED METHOD

(71) Applicant: Credence Engineering, Inc., Tempe, AZ (US)

(72) Inventor: James Edward Ellis, Tempe, AZ (US)

(73) Assignee: Credence Engineering, Inc., Tempe, AZ (US)

( * ) Notice: Subject to any disclaimer, the term of this patent is extended or adjusted under 35 U.S.C. 154(b) by 0 days.

(21) Appl. No.: 17/845,903

(22) Filed: Jun. 21, 2022

(51) Int. Cl.
*B65B 43/54* (2006.01)
*A24F 40/70* (2020.01)
*B67C 3/22* (2006.01)

(52) U.S. Cl.
CPC ..... *B65B 43/54* (2013.01); *A24F 40/70* (2020.01); *B67C 3/225* (2013.01)

(58) Field of Classification Search
CPC ..... B65B 43/54; A24F 40/70; B67C 3/225
See application file for complete search history.

(56) References Cited

U.S. PATENT DOCUMENTS 1,560,050 A * 11/1925 Gearhart ..... B65B 43/54 152/243
10,011,381 B2 * 7/2018 Deutschle ..... B65D 51/241
10,207,832 B2 * 2/2019 Narvekar ..... A61J 1/1412
10,850,874 B2 * 12/2020 Boldrini ..... B65B 3/28
2003/0044324 A1 * 3/2003 Micklash, II ..... B01J 19/0046 435/305.3
2003/0175164 A1 * 9/2003 Micklash, II ..... B01L 3/50255 422/131
2014/0196411 A1 * 7/2014 Procyshyn ..... B65B 7/2821 141/1
2015/0089830 A1 * 4/2015 Wissner ..... B65B 7/2892 34/92

(Continued)

FOREIGN PATENT DOCUMENTS

CN 115384863 A * 11/2022

OTHER PUBLICATIONS

Jupiter Research webpage having the URL address www.jupiterresearch.com/convectium/ as archived on Jun. 21, 2021 at https://web.archive.org/web/20210621033417/jupiterresearch.com/convectium.

(Continued)

*Primary Examiner* — Nicolas A Arnett
(74) *Attorney, Agent, or Firm* — Haynes and Boone, LLP

(57) ABSTRACT

A stabilizing upper tray for stabilizing cartridges during automated filling operations includes fill ports matching cartridge support locations in a lower support tray. Each fill port includes a bore, a circular recess to engage the upper rim of a cartridge, and an inwardly tapered needle-engaging surface adapted to be engaged by a fluid injection needle; a counterbore extends between the bore and the circular recess. As the upper tray is lowered over the cartridges, the enlarged recess of each fill port engages a corresponding cartridge and guides it into a vertical orientation within the counterbore. During filling operations, a mis-aligned fluid injection needle engages the inwardly tapered needle-engaging surface of the stabilizing upper tray and is guided through the fill port toward the cartridge. A method is also disclosed to form such a stabilizing upper tray through conversion of a conventional lower support tray.

13 Claims, 9 Drawing Sheets

(56) References Cited

U.S. PATENT DOCUMENTS

| | | | | |
|---|---|---|---|---|
| 2018/0170588 | A1* | 6/2018 | Boldrini | A24F 40/70 |
| 2020/0015516 | A1* | 1/2020 | Simpson | A24D 3/061 |
| 2021/0171231 | A1* | 6/2021 | Bumatai | B65B 3/12 |
| 2021/0221547 | A1* | 7/2021 | Zaniboni | A24F 40/10 |
| 2022/0033124 | A1* | 2/2022 | Partansky | B65B 3/12 |
| 2022/0227566 | A1* | 7/2022 | Nau | A61M 15/00 |
| 2023/0063630 | A1* | 3/2023 | Testoni | B65B 43/54 |

OTHER PUBLICATIONS

PDF file named "ATG_Video_05-27-2020_0-12.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 12 seconds into the video.

PDF file named "ATG_Video_05-27-2020_0-20.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 20 seconds into the video.

PDF file named "ATG_Video_05-27-2020_0-24.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 24 seconds into the video.

PDF file named "ATG_Video_05-27-2020_0-32.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 32 seconds into the video.

PDF file named "ATG_Video_05-27-2020_0-39.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 39 seconds into the video.

PDF file named "ATG_Video_05-27-2020_1-13.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 0 minutes and 13 seconds into the video.

PDF file named "ATG_Video_05-27-2020_1-26.pdf" corresponding to a screen capture of the video named "Full Cartridge Filling Automation—New ATG Pharma, Jupiter, and Convectium Collaboration" published at https://www.youtube.com/watch?v=SxQHCidmj9c on May 27, 2020, as captured at 1 minutes and 26 seconds into the video.

* cited by examiner

UPPER STABILIZING TRAY FOR FILLING CARTRIDGES AND RELATED METHOD

BACKGROUND OF THE INVENTION

Technical Field

The present invention relates generally to machines for filling an array of cartridges with fluids, and more particularly to an upper stabilizing tray for enhancing the accuracy and reliability of such filling operations.

State of the Art

Electronic cigarettes, or e-cigarettes, have become popular among smokers who wish to avoid inhaling toxic byproducts of burning tobacco and the outer paper liner. These devices are typically battery-operated and are used by people to inhale vapors that typically contain nicotine. Such devices are also known as "vapes" or "vape pens". A liquid solution containing nicotine in an oil base, and possibly other ingredients such as flavorings, is packaged in a cartridge having a heater to atomize the liquid so that it can be inhaled. The cartridge is installed in a vape pen having a battery, and the battery supplies electrical power to the cartridge's heater for vaporizing the liquid solution stored in the cartridge.

The same principles of "vaping" have been applied to smoking of marijuana, or cannabis. Tetrahydrocannabinol, or "THC", is the main psychoactive compound contained in the cannabis plant that gives a sensation of being "high". THC can be consumed by smoking marijuana, but it is also available as cannabis oil, or "marijuana oil". Such oils are typically produced by extracting such oils from the cannabis plant using a solvent, and then refining the extracted composition, as by filtration and distillation or the like. This cannabis oil can then be vaporized in a heated cartridge, and inhaled, in a manner like that used for e-cigarettes.

Several manufacturers supply empty cartridges shipped in a lower support tray ready to be filled with nicotine-based solutions or cannabis oil. For example, Jupiter Research, LLC of Phoenix, Ariz., and Boldcarts of Tempe, Ariz., both sell empty cartridges supplied in a lower support tray having an array of ten rows by ten columns and providing 100 cartridges per lower support tray. These cartridges include transparent cylindrical sidewall portions typically made of polycarbonate material, although such transparent cylindrical sidewall portions may also be made of glass. The cartridges are shipped pre-loaded in such support trays, with the open upper-ends of the cartridges ready to be filled. After filling, such cartridges are capped to prevent the filled fluid from leaking out; the installed cap often includes a mouthpiece used to inhale vapor after the cartridge is installed into a vape pen.

A number of manufacturers provide oil filling machines designed to fill the empty cartridges in an automated fashion. A tray of 100 empty cartridges is inserted into the automated filling machine. A needle used to inject a desired fluid, such as cannabis oil, is supported above the inserted tray of cartridges. The needle is aligned above each empty cartridge, either by moving the needle relative to the tray of cartridges, or by moving the tray of cartridges relative to the needle. Once aligned, the needle is typically lowered to the upper rim of the cartridge, oil is injected, the needle is raised, and the process is repeated for the next cartridge to be filled. One such automated filling machine is commercially available from ATG Pharma Inc. of Oakville, Ontario, Canada.

Applicant has found that problems frequently arise when using such automated filling machines due to misalignment of cartridges. Often, one or more cartridges positioned in the lower support tray are not oriented in a truly vertical orientation, but rather extend at an angle. In other instances, the lower support tray is incorrectly aligned with the filling machine. In either case, as the filling needle is lowered, the filling needle often impacts the upper rim of the cartridge. In such instances, the oil filling machine either halts operation or the fluid being injected is at least partially directed along the outside of the cartridge rather than within the cartridge. When the filling machine halts operation, valuable time must be spent to correct the error, and as a result, the production rate decreases. On the other hand, when fluid is mis-directed outside the cartridge, an oily mess often results, and one or more cartridges are not filled with the proper amount of fluid, resulting in quality control problems.

Accordingly, a solution is needed to maintain the empty cartridges in proper vertical orientation, to prevent the filling needle from striking the upper rim of the cartridge as the filling needle is lowered, and to ensure that dispensed fluid is actually dispensed within each cartridge during filling operations.

SUMMARY OF THE INVENTION

Briefly described, and in accordance with various embodiments thereof, a first aspect of the present invention relates to a stabilizing upper tray for stabilizing cartridges during a filling operation. The cartridges are typically supported in a patterned array of cartridge holding locations formed in a lower support tray. Each of the cartridges has an upper circular rim of a first diameter through which a fluid may be injected.

The stabilizing upper tray includes an upper surface and an opposing lower surface. A series of ports are provided in the upper stabilizing tray in a patterned array generally matching the patterned array of cartridge holding locations formed in the lower support tray. Each such port has a circular bore communicating between the upper surface and the lower surface of the stabilizing upper tray. Each such circular bore has an internal diameter slightly smaller than the first diameter of the upper rim of the cartridges. Each port also includes an enlarged generally-circular recess accessible from the lower surface of the stabilizing upper tray and concentric with the circular bore of the corresponding port; each generally circular recess is adapted to engage the upper rim of a corresponding cartridge as the stabilizing upper tray is lowered onto the cartridges positioned in the lower support tray.

Each of the ports provided in the upper stabilizing tray also includes an inwardly tapered needle-engaging surface extending from the upper surface of the stabilizing upper tray toward the circular bore of the corresponding port. Each such needle-engaging surface is adapted to be engaged by a fluid injection needle of an automated filling machine as the fluid injection needle is lowered toward the cartridge located below the corresponding port. The needle-engaging surface guides the fluid injection needle into the circular bore of the corresponding port and into the cartridge located below the corresponding port.

In some embodiments of the invention, each of the ports includes a counterbore concentric with the circular bore and generally extending between the circular bore and the enlarged generally-circular recess. The counterbore has an internal diameter slightly larger than the first diameter of the upper rim of the cartridges for receiving the upper circular rim of a corresponding cartridge.

In some embodiments of the invention, each enlarged generally-circular recess includes an inwardly tapered rim-engaging surface extending toward the counterbore of the corresponding port, wherein the rim-engaging surface is adapted to engage the upper rim of a corresponding cartridge as the stabilizing upper tray is lowered onto the cartridges positioned in the lower support tray. The inwardly tapered rim engaging surface guides the corresponding cartridge into an upright orientation within the associated counterbore as the stabilizing upper tray is lowered over the cartridges. In some embodiments, this inwardly tapered rim-engaging surface includes a truncated conical surface. In various embodiments, the diameter of this truncated conical surface is, at a minimum, greater than the diameter of the upper circular rim of the cartridge. In some embodiments of the invention, a circular flange is located between the circular bore and the truncated conical surface of the rim-engaging surface; this circular flange is adapted to bear against the upper rim of a cartridge engaged by the corresponding port when the cartridge is in an upright orientation.

In some embodiments of the invention, the needle-engaging surface defines a truncated conical surface.

In accordance with other embodiments, thereof, the present invention relates to a method for stabilizing cartridges during filling operations. Each of the cartridges has an upper circular rim of a first diameter through which fluid may be injected. The aforementioned method includes the step of providing empty cartridges supported within cartridge-holding locations of a lower support tray, wherein the cartridge-holding locations are arranged in a patterned array. The lower support tray, and the cartridges supported therein, are inserted into a fluid cartridge filling machine.

The aforementioned method includes the step of providing a stabilizing upper tray having an upper surface, an opposing lower surface, and a series of ports arranged in a patterned array generally matching the patterned array of cartridge holding locations formed in the lower support tray. Each port includes a circular bore communicating between the upper surface and the lower surface of the stabilizing upper tray, each circular bore having an internal diameter slightly smaller than the first diameter of the upper rim of the cartridges. Each port also includes an enlarged generally-circular recess accessible from the lower surface of the stabilizing upper tray and concentric with the circular bore of the corresponding port, the enlarged generally-circular recess being adapted to engage the upper rim of a corresponding cartridge as the stabilizing upper tray is lowered onto the cartridges positioned in the lower support tray. Each port also includes an inwardly tapered needle-engaging surface extending from the upper surface of the stabilizing upper tray toward the circular bore of the corresponding port, the needle-engaging surface being adapted to be engaged by a fluid injection needle of the automated filling machine.

The aforementioned method includes the further step of lowering the stabilizing upper tray onto the cartridges positioned in the lower support tray, and engaging the upper rim of each cartridge with the enlarged generally-circular recess of a corresponding port for guiding the cartridges into an upright orientation. The fluid injection needle of the automated filling machine is lowered toward a cartridge to fill it with fluid, and the needle-engaging surface of each port helps guide the fluid injection needle into the circular bore of the corresponding port for dispensing fluid into the cartridge located below the corresponding port.

In some embodiments of the aforementioned method, each port includes a counterbore concentric with the circular bore and generally extending between the circular bore and the enlarged generally-circular recess, the counterbore having an internal diameter slightly larger than the first diameter for receiving the upper circular rim of a corresponding cartridge. The step of lowering the stabilizing upper tray onto the cartridges includes the step of advancing the upper rim of each cartridge into the counterbore of the corresponding port to maintain the cartridge in an upright, stabilized orientation.

In some embodiments of the aforementioned method, the enlarged generally-circular recess of each port includes an inwardly tapered rim-engaging surface extending toward the circular bore of the corresponding port. This rim-engaging surface is adapted to engage the upper rim of a corresponding cartridge as the stabilizing upper tray is lowered onto the cartridges positioned in the lower support tray for guiding the corresponding cartridge into an upright orientation. The step of lowering the stabilizing upper tray onto the cartridges positioned in the lower support tray includes the step of engaging the upper rim of each cartridge with the rim-engaging surface of a corresponding port for guiding the cartridges into an upright orientation as the stabilizing upper tray is lowered onto the cartridges.

Another aspect of the present invention relates to a method for converting a conventional cartridge carrier tray into an upper stabilizing support tray. The conventional cartridge carrier tray includes an upper face, an opposing lower face, and a patterned array of cartridge holding locations formed therein and adapted to support cylindrical cartridges of a predetermined outer diameter. Each cartridge holding location includes a first collar extending from the upper face, a second collar extending from the lower face, and an axial through-hole extending concentrically through the first collar and second collar. The first collar of each cartridge holding location has a counterbore hole extending therein for receiving the base of a cartridge. The counterbore hole is concentric with, and communicates with, the axial through-hole. The counterbore hole has an internal diameter proximate to, but greater than, the predetermined outer diameter of the cylindrical cartridges.

The aforementioned method for converting a cartridge carrier tray into an upper stabilizing support tray includes the step of removing the second collar from each of the cartridge holding locations to provide an essentially planar lower face on the cartridge carrier tray. The method also includes the step of forming inwardly-tapering needle-engaging bevels at each cartridge holding location, extending from the lower face of the cartridge carrier tray into each enlarged circular bore, the needle-engaging bevels being adapted to guide a fluid injection needle into the enlarged circular bore.

In some embodiments of the aforementioned method for converting a cartridge carrier tray into an upper stabilizing support tray, each first collar includes a rim, and the method includes the further step of forming inwardly-tapering rim-engaging bevels at each cartridge holding location, extending from the rim of each first collar generally toward the enlarged circular bore, the rim-engaging bevels being adapted to guide an upper end of a cartridge into aligned engagement with the first collar.

In some embodiments of the aforementioned method for converting a cartridge carrier tray into an upper stabilizing support tray, the cartridge carrier tray, after being modified as described above, is flipped so that the upper face of the cartridge carrier tray faces downward toward the cartridges, and so that the lower face of the cartridge carrier tray faces upward.

The foregoing and other features and advantages of the present invention will become more apparent from the following more detailed description of particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein:

DETAILED DESCRIPTION

Figure 1:
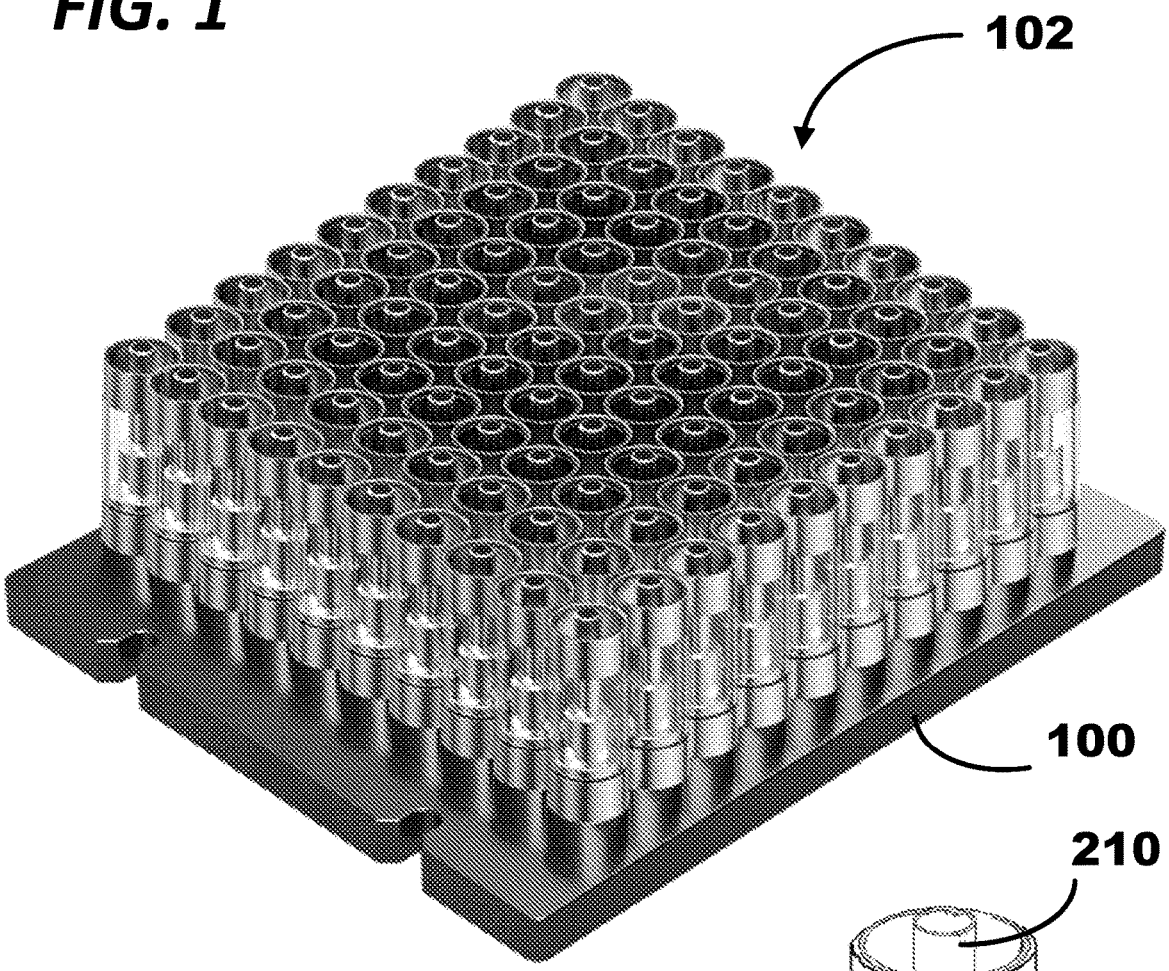
FIG. 1 is a perspective view of a lower support tray pre-loaded with one-hundred cartridges in a patterned array of ten rows by ten columns.

Shown in FIG. 1 is a conventional lower support tray 100 for supporting an array 102 of cartridges ready to be filled with a nicotine-containing e-cigarette solution, cannabis oil or the like. The array 102 of cartridges are supported in a patterned array of cartridge holding locations, for example, an array of ten rows and ten columns, formed in lower support tray 100. Lower support tray 100 and array 102 of cartridges may be of the type commercially available, for example, from Jupiter Research, LLC of Phoenix, Ariz.

Figure 2:
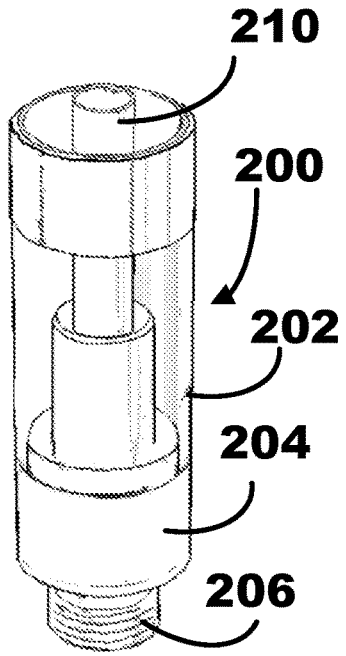
FIG. 2 is a perspective view of one of the cartridges shown in FIG. 1.

Shown in FIG. 2 is a cartridge 200 of the type loaded in array 102 of FIG. 1. Cartridge 200 typically includes a cylindrical sidewall 202, a metallic base 204, a threaded fastener 206, an upper rim 208, and a vapor tube 210. Metallic base 204 may house an electrical heating element used to vaporize the fluid contents of cartridge 200. Threaded fastener 206 may be used to connect the cartridge to a vape pen (not shown); electrical connections from the heater of cartridge 200 may pass through threaded fastener 206 for contacting the terminals of a battery within the vape pen. After fluid is filled within cartridge 200, a mouthpiece may be capped over upper rim 208 to prevent the filled fluid from escaping; the mouthpiece includes a passage for sealing with the end of vapor tube 210 to allow vapor to be inhaled through the user's mouth.

Figure 3:
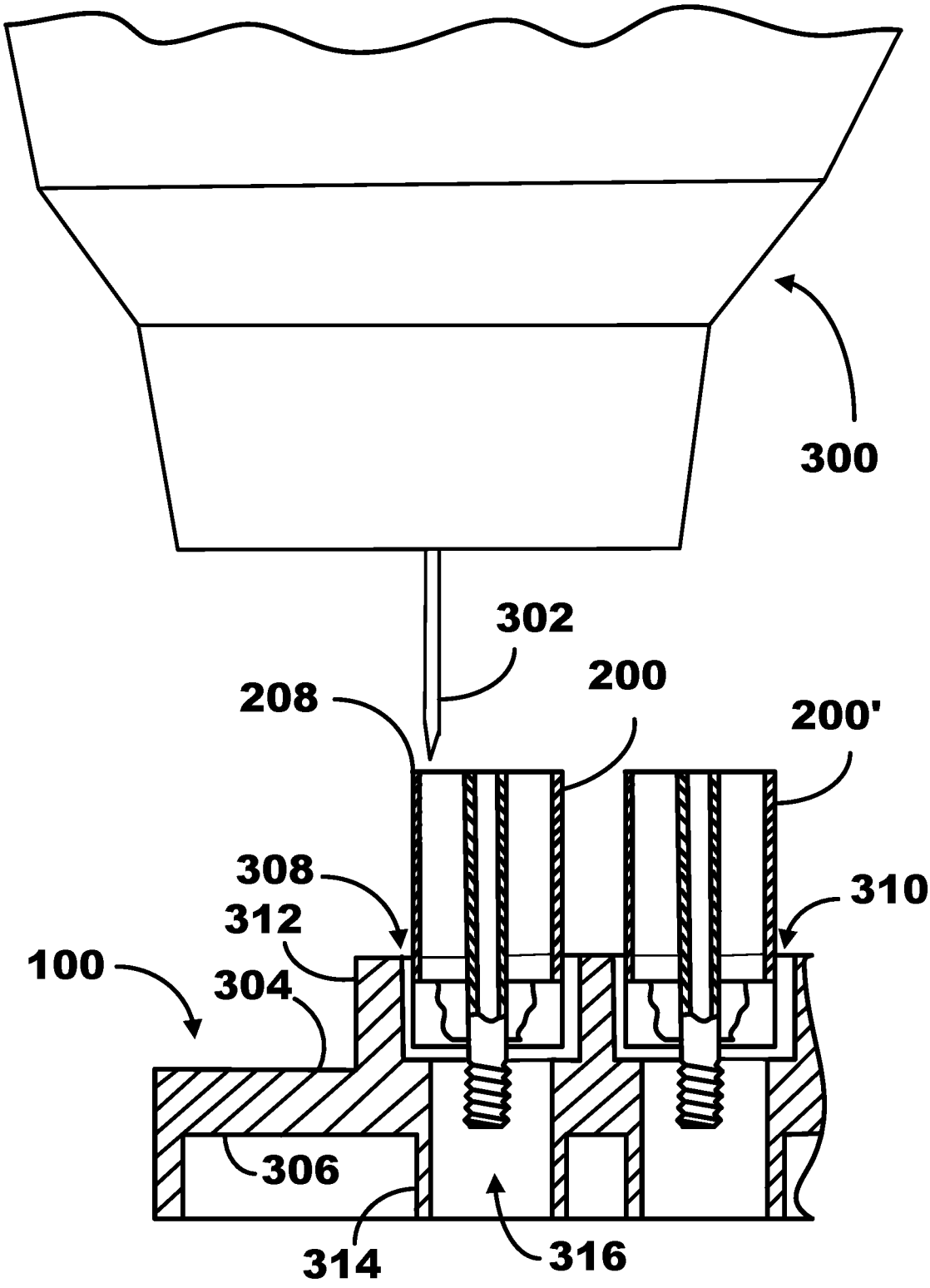
FIG. 3 is a partial sectional view of a cartridge lower support tray loaded in an automated filling machine having a movable fluid injection needle used to sequentially fill cartridges supported by the lower support tray in accordance with the prior art.

In FIG. 3, a portion of lower support tray 100 is shown in cross-section, along with two cartridge support locations in which cartridges 200 and 200' are supported. Also shown in FIG. 3 is the injection head of an automated filling machine 300 having a fluid injection needle 302. Such automated filling machines are commercially available from a number of manufacturers including ATG Pharma Inc. of Oakville, Ontario, Canada. Such automated filling machines typically include a mechanism for raising and lowering fluid injection needle 302, as well as an indexing mechanism for moving the associated injection head along horizontal x-y coordinates in order to sequentially position fluid injection needle 302 over each cartridge 200 in the array 102 of cartridges.

Still referring to FIG. 3, lower cartridge support tray 100 has an upper face 304 and an opposing lower face 306. Lower cartridge support tray 100 also includes a patterned array of cartridge holding locations formed therein, including the support locations designated 308 and 310 in FIG. 3. Support locations 308 and 310 are adapted to support cartridges 200 and 200'. Cartridges 200 and 200' generally have a predetermined outer diameter. Cartridge holding location 308 includes an upper collar 312 that extends from upper face 304 of lower support tray 100. A lower collar 314 extends from lower face 306 of lower support tray coaxially with upper collar 312. An axial through-hole 316 extends concentrically through upper collar 312 and lower collar 314. Upper collar 312 has an enlarged counterbore hole formed therein for receiving the base of cartridge 200; this counterbore hole is concentric with, and communicates with, axial through-hole 316. The counterbore hole has an internal diameter proximate to, but greater than, the predetermined outer diameter of cylindrical cartridges 200 and 200'.

As described in conjunction with FIG. 2, cartridge 200 includes an upper circular rim 208 through which a fluid may be injected. In some instances, one or more of cartridges 200/200' may be cocked at an angle rather than being supported in a truly vertical orientation. This may result from the fact that the counterbore hole in which the base of the cartridge 200 is supported is of a larger diameter than the outer diameter of cartridge 200. In other instances, lower support tray 100 may not be perfectly aligned with the fluid injection head of automated filling machine 300. In either case, fluid injection needle 302 may strike upper rim 208 when being lowered; as a result, automated filling machine 300 may need to be halted to correct the problem. In other cases, fluid injection needle may actually be lowered along the outside of cartridge 200, resulting in the fluid being dispensed onto lower support tray 100, along with one or more empty cartridges.

Figure 4:
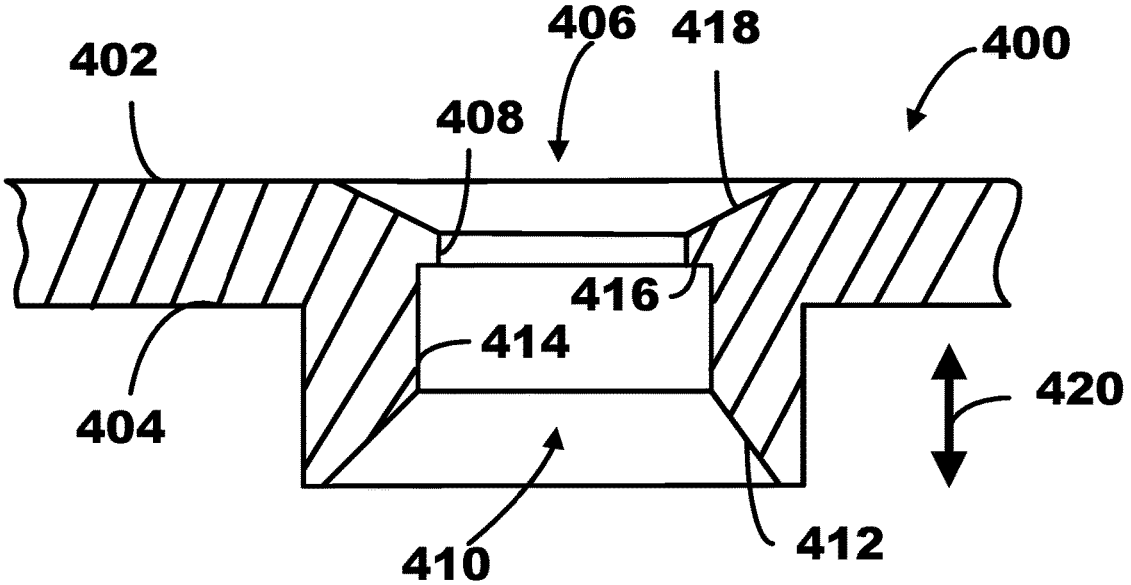
FIG. 4 is a cross-sectional diagram illustrating a cartridge supported within a lower support tray, and one of the ports of a stabilizing upper tray in accordance with an embodiment of the present invention.
Figure 4:
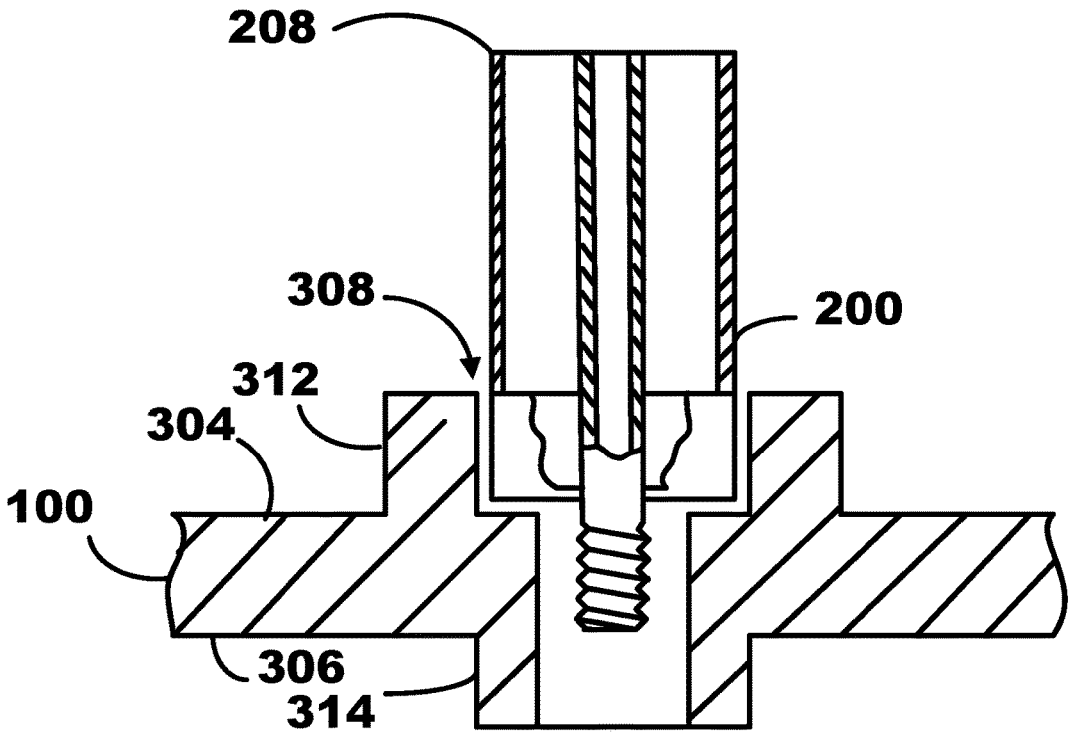

Turning now to FIG. 4, a portion of lower support tray 100 and cartridge 200 are shown, along with a portion of stabilizing upper tray 400. Upper stabilizing tray 400 includes an upper surface 402 and an opposing lower surface 404. A series of fill ports, including fill port 406, are provided in upper stabilizing tray 400, arranged in a patterned array generally matching the patterned array of cartridge holding locations 308/310 formed in lower support tray 100. Thus, if lower support tray 100 includes a ten-by-ten array of cartridge holding locations 308/310, then stabilizing upper tray 400 also includes a ten-by-ten array of fill ports 406. Each fill port 406 has a circular bore 408 communicating between upper surface 402 and lower surface 404 of stabilizing upper tray 400. Circular bore 408 has an internal diameter slightly smaller than the diameter of upper circular rim 208 of cartridge 200. Circular bore 408 leads to an enlarged counterbore 414 which is concentric with circular bore 408. Counterbore 414 extends downwardly from circular bore 408 and has an internal radius that is slightly larger than the diameter of upper circular rim 208 of cartridge 200. A circular flange 416 extends between circular bore 408 and counterbore 414. Circular flange 416 is adapted to bear against upper rim 208 of cartridge 200 once stabilizing upper tray 400 has been fully lowered.

Still referring to FIG. 4, fill port 406 includes an enlarged generally-circular recess 410 accessible from lower surface 404 of stabilizing upper tray 400 and concentric with circular bore 408 and counterbore 414 of fill port 406. Generally circular recess 410 is adapted to engage upper rim 208 of corresponding cartridge 200 as stabilizing upper tray 400 is lowered onto the array of cartridges 102 positioned in lower support tray 100. Preferably, recess 410 includes an inwardly tapered rim-engaging surface 412 extending upwardly and inwardly toward circular bore 408 of fill port 406. As shown in FIG. 4, rim-engaging surface may be provided in the form of a truncated conical surface. Alternatively, rim-engaging surface 412 could be provided as an inwardly curved arcuate surface, if desired. As shown in FIG. 4, the truncated conical rim-engaging surface 412 has a minimum diameter at its uppermost reach that is greater than the internal diameter circular bore 408, and which is preferably continuous with the walls of counterbore 414.

Rim-engaging surface 412 is adapted to engage upper rim 208 of cartridge 200 as stabilizing upper tray 400 is lowered over cartridge 200. Arrow 420 in FIG. 4 indicates that stabilizing upper tray 400 can be lowered or raised (e.g., manually) relative to lower support tray 100. As stabilizing upper tray 400 is lowered, rim-engaging surface 412 of recess 410 engages upper rim 208 of cartridge 200 and guides cartridge 200 into counterbore 414 for a more perfect upright orientation. Assuming that the lower support tray 100 contains one-hundred cartridges, the one-hundred fill ports of stabilizing upper tray 400 serve to simultaneously guide all one-hundred cartridges into an upright orientation simultaneously.

Figure 5:
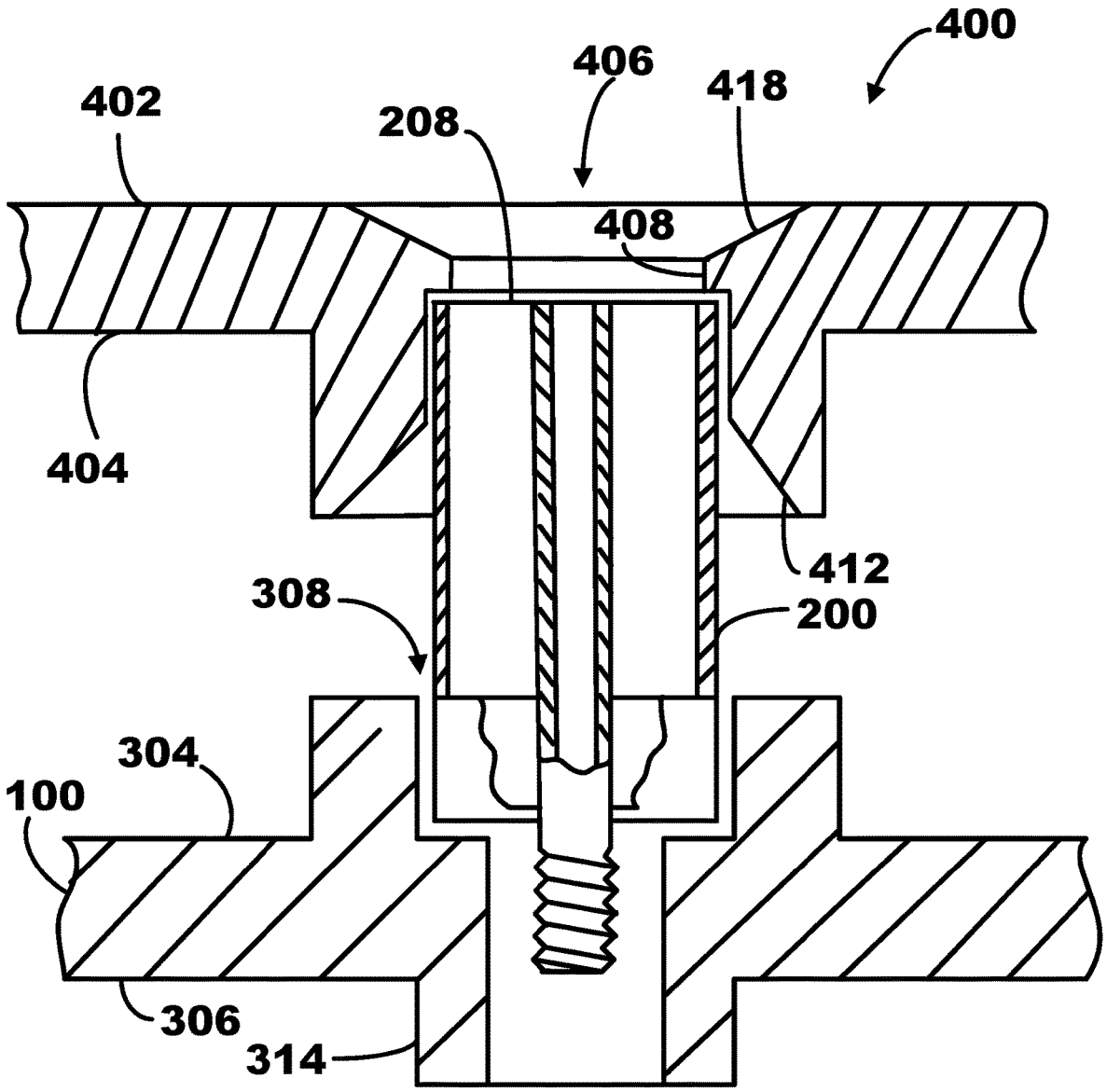
FIG. 5 is a cross-sectional diagram similar to FIG. 4 wherein the stabilizing upper tray has been fully lowered onto the cartridge shown in FIG. 4.

FIG. 5 illustrates the relationship between stabilizing upper tray 400 and cartridge 200 once stabilizing upper tray has been fully-lowered over the cartridge array 102 supported by lower tray 100. It will be noted that upper rim 208 of cartridge 200 lies below circular flange 416. Accordingly, if fluid injection needle 302 is lowered through fill port 406 into circular bore 408, the tip of fluid injection needle will not strike upper rim 208 of cartridge 200.

Figure 6:
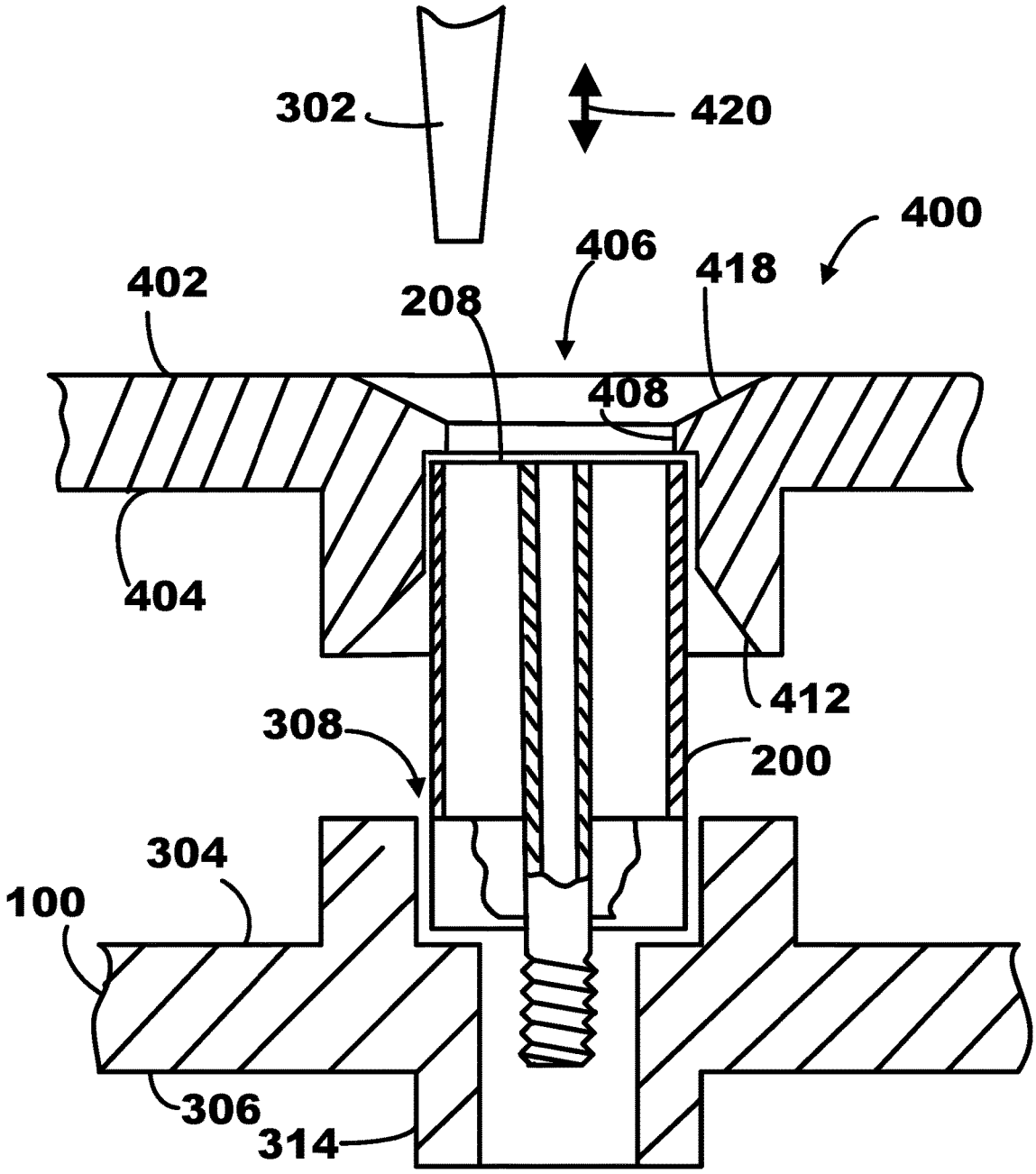
FIG. 6 is a cross-sectional diagram similar to FIGS. 4 and 5 wherein a fluid injection needle of an automated filling machine is positioned above a fill port of the stabilizing upper tray.
Figure 7:
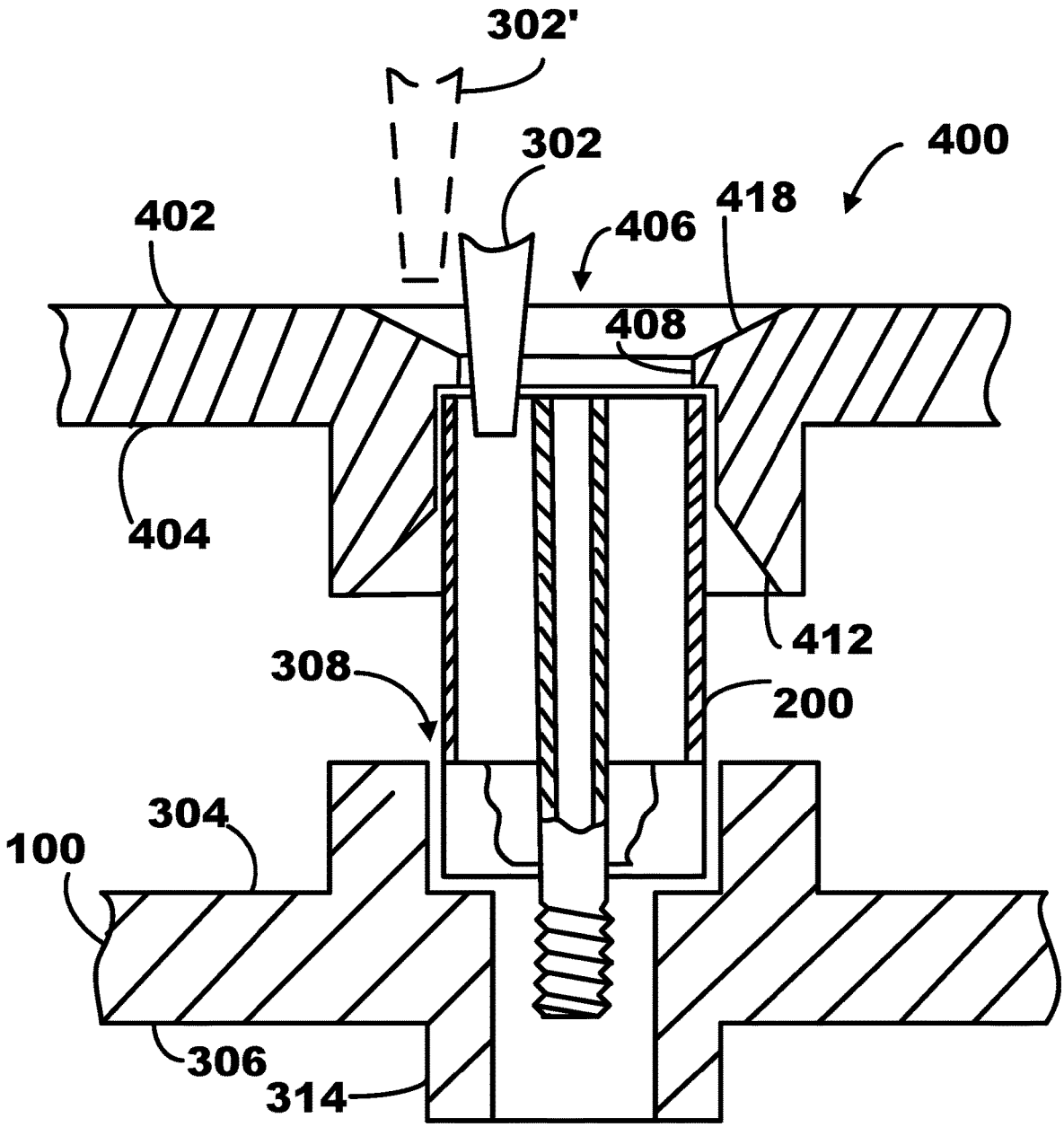
FIG. 7 is a cross-sectional diagram similar to FIGS. 4-6 wherein the fluid injection needle of the automated filling machine has been lowered into the fill port of the stabilizing upper tray for injecting fluid into the cartridge positioned therebelow.

Returning briefly to FIG. 4, an inwardly tapered needle-engaging surface 418 extends from upper surface 402 of stabilizing upper tray 400 toward circular bore 408 of fill port 406. As shown in FIG. 4, needle-engaging surface 418 may define a truncated conical surface. As shown in FIG. 6, fluid injection needle 302 is adapted to be lowered to, and raised from, stabilizing upper tray, as indicated by arrow Needle-engaging surface 418 is adapted to be engaged by fluid injection needle 302 of automated filling machine 300 if there is a misalignment between lower support tray 100 and automated filling machine 300. In FIG. 7, the initial, misaligned position of fluid injection needle 302 is indicated by dashed lines 302'. In such an event, as fluid injection needle 302 is further lowered toward cartridge 200, it engages needle-engaging surface 418, which gently guides fluid injection needle 302 into circular bore 408 and toward cartridge 200 located below fill port 406, as indicated in FIG. 7.

Those skilled in the art will appreciate that stabilizing upper tray 400 facilitates a method for stabilizing cartridges during filling operations. In practicing such method according to one embodiment, cartridge array 102 of FIG. 1 is supported within cartridge-holding locations of lower support tray 100 in a patterned array. Upper stabilizing tray 400 is provided, including its upper and lower opposing surfaces 402 and 404, respectively. Upper stabilizing tray 400 includes its series of fill ports 406 patterned to match the patterned array of cartridge holding locations formed in lower support tray 100. Each such fill port 406 has a circular bore 408 communicating between upper surface 402 and lower surface 404, and circular bore 408 has an internal diameter slightly smaller than the outer diameter of the cartridges 102/200. In addition, each of such fill ports 406 includes an enlarged generally-circular recess 410 accessible from lower surface 404, concentric with circular bore 408. Circular bore 408 preferably communicates with enlarged generally-circular recess 410 via counterbore 414. As has been explained above, generally-circular recess 410 is adapted to engage upper rim 208 of a corresponding cartridge 200. Each such fill port 406 also includes an inwardly tapered needle-engaging surface 418 extending from upper surface 402 toward circular bore 408. As was explained above, needle-engaging surface 418 is adapted to be engaged by fluid injection needle 302.

A further step of the aforementioned method is to lowering stabilizing upper tray 400 onto the cartridges 102 positioned in lower support tray 100. This step is generally performed before lower support tray 100 and cartridge array 102 are inserted into automated filling machine 300, but in some instances, the step of lowering stabilizing upper tray 400 onto the cartridges 102 may be performed after lower support tray 100 and cartridge array 102 are inserted into automated filling machine 300. As stabilizing upper tray 400 is lowered onto cartridge array 102, the upper rim 208 of each cartridge 102/200 is engaged by a corresponding enlarged generally-circular recess 410 of a corresponding fill port 406 for ensuring that each cartridge 200 is in an upright, vertical orientation. In practicing this method, generally-circular recess 410 may include an inwardly tapered rim-engaging surface 412 extending toward circular bore 408. As has already been described, rim-engaging surface 412 is adapted to engage upper rim 208 of cartridge 200 as stabilizing upper tray 400 is lowered onto cartridge array 102 for guiding the corresponding cartridge to an upright orientation, and facilitating passage of upper rim 208 into counterbore 414 until upper rim 208 engages circular flange 416.

After the stabilized cartridge array 102 is established within automated filling machine 300, filling operations may begin. Fluid injection needle 302 is lowered toward each cartridge 200 to fill each cartridge 200 with fluid; needle-engaging surface 418 of each fill port 406 guides fluid injection needle 302 into circular bore 408 for dispensing fluid into cartridge 200 located below corresponding fill port 406.

Once the cartridges in lower support tray 100 have been filled, the assemblage of lower support tray, cartridge array 102, and stabilizing upper tray 400, is removed from automated filling machine 300, and stabilizing upper tray 400 is raised from the cartridge array 102. The filled cartridges may then be capped in the usual manner.

Figure 8:
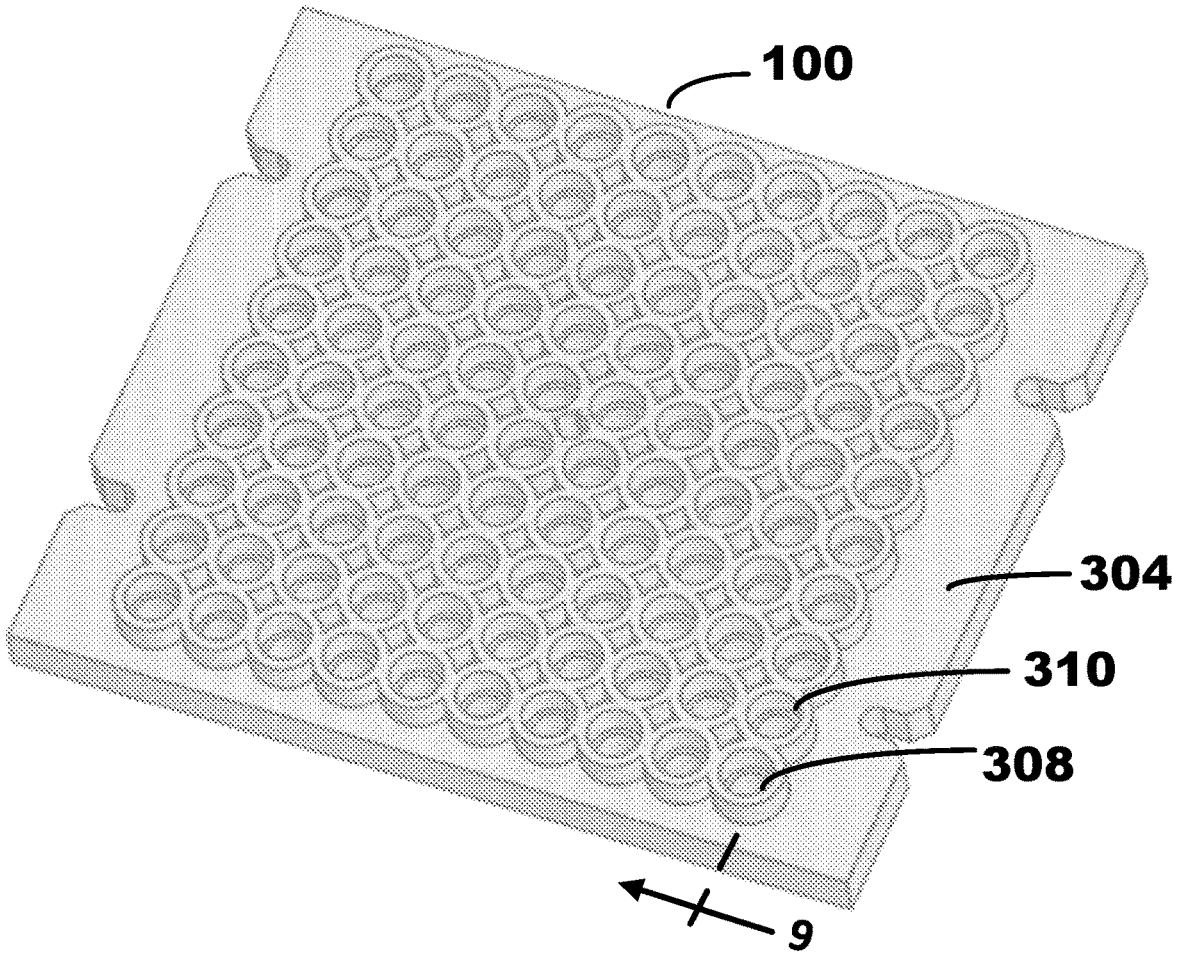
FIG. 8 is a perspective view of the upper face of a conventional lower support tray prior to modification.

Another aspect of the present invention regards a method for producing such a stabilizing upper tray through conversion of a conventional lower support cartridge carrier tray. FIG. 8 is an upper perspective view of a conventional lower support tray 100 of the type commercially available, for example, from Jupiter Research, LLC of Phoenix, Ariz. In the cross-sectional drawing of FIG. 9, two of the cartridge holding locations 308 and 310 are shown in greater detail. Lower support tray 100 has an upper face 304 and an opposing lower face 306. Lower support tray 100 includes a patterned array of cartridge holding locations formed therein for supporting cylindrical cartridges, including cartridge holding locations 308 and 310.

Figure 9:
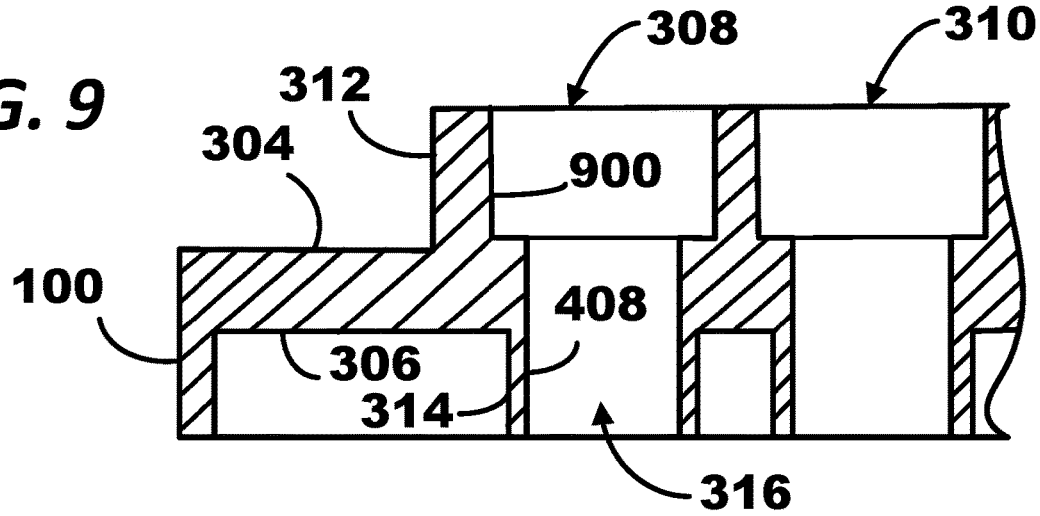
FIG. 9 is a partial cross-sectional drawing of two of the cartridge support locations shown in FIG. 8 prior to modification.

As shown in FIG. 9 relative to cartridge holding location 308, each cartridge holding location includes a first, upper collar 312 extending from upper face 304, a second, lower collar 314 extending from lower face 306, and an axial through-hole 316 extending concentrically through upper collar 312 and lower collar 314 Axial through-hole 316 corresponds to circular bore 408, which has an internal diameter smaller than the outer diameter of the cartridges supported by lower support tray 100. In addition, the upper collar 312 of each cartridge holding location 308 has a counterbore hole 900 extending therein for receiving the base of a cartridge 200. Counterbore hole 900 is concentric with, and communicates with, axial through-hole 316. The internal diameter of counterbore hole 900 is slightly greater than the outer diameter of cylindrical cartridge 200 for allowing the base 204 of cartridge 200 to be received therein.

Figure 10:
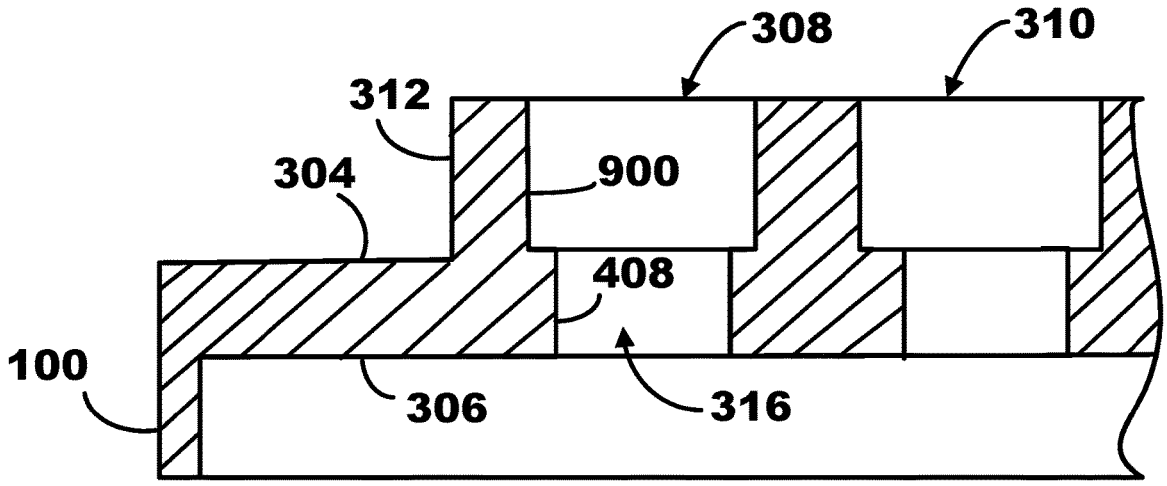
FIG. 10 is a cross-sectional drawing similar to FIG. 9 but illustrating the removal of the downwardly-extending collars originally provided at the two cartridge support locations.

The method for converting lower support tray 100 into stabilizing upper tray 400 includes the step of removing lower collar 314 from each of the cartridge holding locations 308/310 to provide an essentially planar lower face 306 below lower support tray 100. FIG. 10 illustrates the appearance of lower support tray 100 following the removal of lower collars 314.

The method for converting lower support tray 100 into stabilizing upper tray 400 also includes the step of forming inwardly-tapering needle-engaging bevels 418 at each cartridge holding location 308/310, extending from lower face 306 into each enlarged circular bore 408. As explained earlier, these needle-engaging bevels 418 are adapted to guide fluid injection needle 302 into enlarged circular bore 408.

Figure 11:
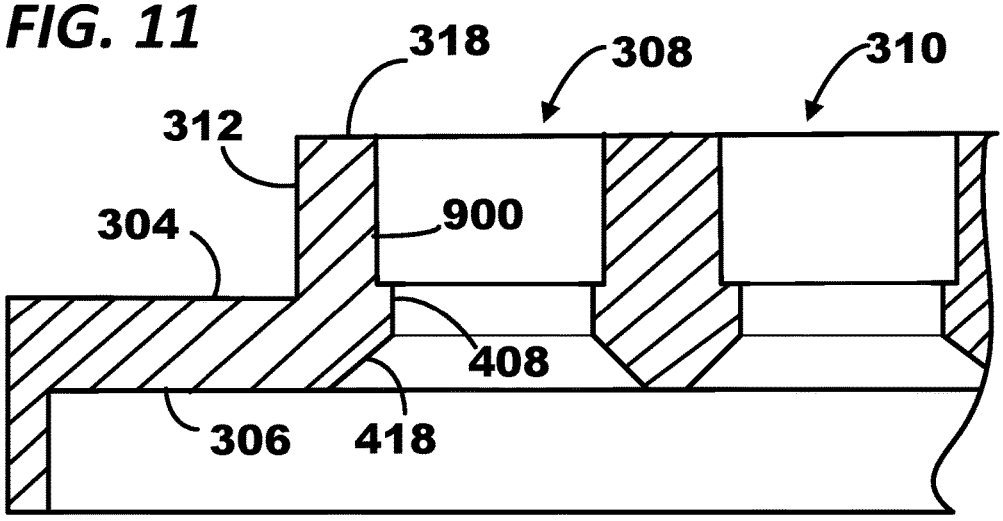
FIG. 11 is a cross-sectional drawing similar to FIGS. 9-10 but illustrating the formation of inwardly-tapered needle-engaging surfaces surrounding each cartridge support location.
Figure 12:
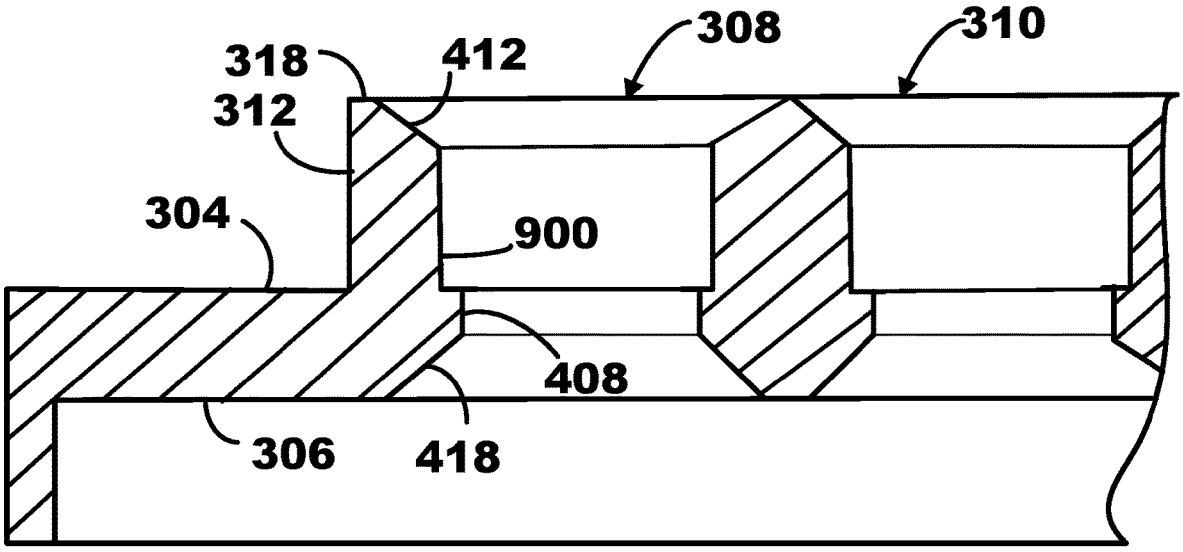
FIG. 12 is a cross-sectional drawing similar to FIGS. 9-11 but illustrating the formation of inwardly tapered rim-engaging surfaces within the collars formerly used to support the base of each cartridge.

Briefly referring to FIG. 11, upper collar 312 surrounding cartridge holding location 308 includes an upper rim 318. In the preferred embodiment, the method for converting lower support tray 100 into stabilizing upper tray 400 also includes the step of forming inwardly-tapering rim-engaging bevels at each cartridge holding location 308/310. Turning to FIG. 12, inwardly-tapering rim-engaging bevels 412 are formed to extend from rim 318 of upper collar 312 generally toward enlarged counterbore 900. Rim-engaging beveled surface 412 is adapted to engage upper rim 208 of cartridge 200, and to align the upper end of cartridge 208 within collar 312. While rim-engaging surface 412 is shown in FIG. 12 as a partial conical surface, rim engaging surface 412 could also be formed as a curved arcuate surface.

Figure 13:
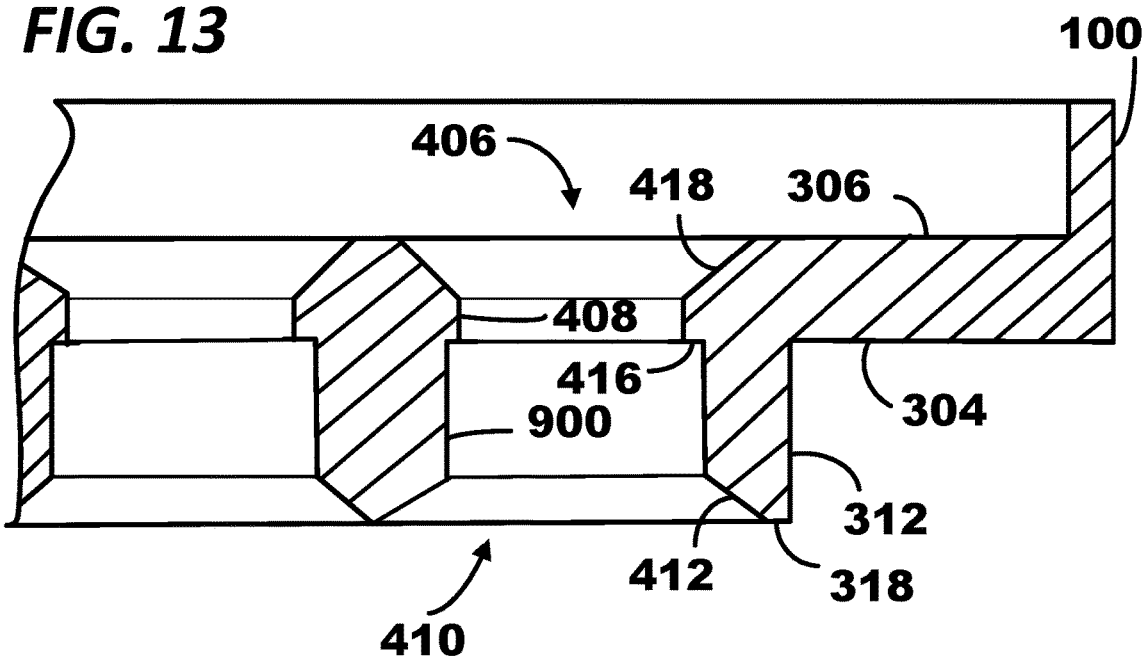
FIG. 13 is a cross-sectional drawing corresponding to FIG. 12, but flipped 180 degrees, to show the orientation of the converted support tray for use as a stabilizing upper tray.

Now referring to FIG. 13, the converted tray of FIG. 12 has been flipped over wherein the upper face 304 of lower support tray 100 now faces downward toward the cartridges, and wherein the lower face 306 of lower support tray 100 faces upward toward fluid injection needle 302. Comparing FIG. 13 to stabilizing upper tray 400 of FIG. 4, it will be noted that essentially all of the features earlier described relative to FIG. 4 are included in the converted tray shown in FIG. 13, including needle-engaging surface 418, rim-engaging surface 412, circular bore 408, counterbore 414/900, and circular flange 416.

Those skilled in the art will appreciate that an improved apparatus and method have now been described for maintaining empty cartridges in proper vertical orientation during filling operations, thereby preventing the fluid injection needle from striking the upper rim of the cartridge as the filling needle is lowered, and ensuring that dispensed fluid is actually dispensed within each cartridge. The disclosed apparatus and method further compensate for misalignment errors between the lower support tray and the fluid injection needle of the automated filling machine by nonetheless guiding the fluid injection needle into each cartridge. The disclosed apparatus and method thereby avoid the need to halt the operation of the oil filling machine due to malfunction, and also avoids inadvertent dispensing of fluid between cartridges, improperly filled cartridges, and the resulting mess.

In addition, those skilled in the art will appreciate that a method has been disclosed for easily converting a conventional lower cartridge support tray into a stabilizing upper tray.

The embodiments specifically illustrated and/or described herein are provided merely to exemplify particular applications of the invention. These descriptions and drawings should not be considered in a limiting sense, as it is understood that the present invention is in no way limited to only the disclosed embodiments. It will be appreciated that various modifications or adaptations of the methods and or specific structures described herein may become apparent to those skilled in the art. All such modifications, adaptations, or variations are considered to be within the spirit and scope of the present invention, and within the scope of the appended claims.

I claim:

1. A stabilizing upper tray for stabilizing cartridges during a filling operation, the cartridges being adapted to be supported by a lower support tray in a patterned array, each of the cartridges having an upper circular rim of a first diameter through which a fluid may be injected, the stabilizing upper tray comprising in combination:

a) an upper surface and an opposing lower surface;

b) a plurality of ports being arranged in a patterned array generally matching the patterned array of cartridges supported by the lower support tray, each of the plurality of ports having a circular bore communicating between the upper surface and the lower surface of the stabilizing upper tray, each circular bore having an internal diameter slightly smaller than the first diameter;

c) each of the plurality of ports including an enlarged generally-circular recess accessible from the lower surface of the stabilizing upper tray and concentric with the circular bore of the corresponding port, each generally circular recess being adapted to engage the upper rim of a corresponding cartridge as the stabilizing upper tray is lowered onto the cartridges supported by the lower support tray for guiding the corresponding cartridge into an upright orientation; and d) each of the plurality of ports including an inwardly tapered needle-engaging surface extending from the upper surface of the stabilizing upper tray toward the circular bore of the corresponding port, the needle-engaging surface being adapted to be engaged by a fluid injection needle of an automated filling machine as the fluid injection needle is lowered toward the cartridge located below the corresponding port, the needle-engaging surface guiding the fluid injection needle into the circular bore of the corresponding port and into the cartridge located below the corresponding port.

2. The stabilizing tray recited by claim 1 wherein each of the plurality of ports includes a counterbore concentric with the circular bore and generally extending between the circular bore and the enlarged generally-circular recess, the counterbore having an internal diameter slightly larger than the first diameter for receiving the upper circular rim of a corresponding cartridge.

3. The stabilizing tray recited by claim 2 wherein each enlarged generally-circular recess includes an inwardly tapered rim-engaging surface extending toward the counterbore of the corresponding port, the rim-engaging surface being adapted to engage the upper rim of a corresponding cartridge as the stabilizing upper tray is lowered onto the cartridges supported by the lower support tray for guiding the corresponding cartridge to an upright orientation within the counterbore.

4. The stabilizing tray recited by claim 3 wherein the rim-engaging surface includes a truncated conical surface.

5. The stabilizing tray recited by claim 4 wherein the truncated conical surface has a minimum diameter greater than the internal diameter of the circular bore.

6. The stabilizing tray recited by claim 2 including a circular flange located between the circular bore and the counterbore, the circular flange being adapted to bear against the upper rim of a cartridge engaged by the corresponding port.

7. The stabilizing tray recited by claim 1 wherein the needle-engaging surface defines a truncated conical surface.

8. A method for stabilizing cartridges during filling operations, each of the cartridges having an upper circular rim of a first diameter through which fluid may be injected, said method including the steps of:

a) providing empty cartridges supported within a lower support tray and arranged in a patterned array;

b) inserting the lower support tray, and the cartridges supported therein, into a fluid cartridge filling machine;

c) providing a stabilizing upper tray, the upper stabilizing tray including:

i) an upper surface and an opposing lower surface;

ii) a plurality of ports arranged in a patterned array generally matching the patterned array of cartridges supported within the lower support tray, each of the plurality of ports having a circular bore communicating between the upper surface and the lower surface of the stabilizing upper tray, and each circular bore having an internal diameter slightly smaller than the first diameter;

iii) each of the plurality of ports including an enlarged generally-circular recess accessible from the lower surface of the stabilizing upper tray and concentric with the circular bore of the corresponding port, the enlarged generally-circular recess being adapted to engage the upper rim of a corresponding cartridge as the stabilizing upper tray is lowered onto the cartridges supported within the lower support tray for guiding the corresponding cartridge into an upright orientation;

iv) each of the plurality of ports including an inwardly tapered needle-engaging surface extending from the upper surface of the stabilizing upper tray toward the circular bore of the corresponding port, the needle-engaging surface being adapted to be engaged by a fluid injection needle of an automated filling machine;

d) lowering the stabilizing upper tray onto the cartridges supported within the lower support tray, and engaging the upper rim of each cartridge with an enlarged generally-circular recess of a corresponding port for guiding the cartridges into an upright orientation; and e) lowering a fluid injection needle toward each cartridge to fill each cartridge with fluid, the needle-engaging surface of each port guiding the fluid injection needle into the circular bore of the corresponding port for dispensing fluid into the cartridge located below the corresponding port.

9. The method recited by claim 8 wherein each of the plurality of ports includes a counterbore concentric with the circular bore and generally extending between the circular bore and the enlarged generally-circular recess, the counterbore having an internal diameter slightly larger than the first diameter for receiving the upper circular rim of a corresponding cartridge, and wherein the step of lowering the stabilizing upper tray onto the cartridges supported within the lower support tray includes the step of advancing the upper rim of each cartridge into the counterbore of the corresponding port to maintain the cartridge in an upright, stabilized orientation.

10. The method recited by claim 9 wherein:

a) the enlarged generally-circular recess of each port includes an inwardly tapered rim-engaging surface extending toward the counterbore of the corresponding port, the rim-engaging surface being adapted to engage the upper rim of a corresponding cartridge as the stabilizing upper tray is lowered onto the cartridges supported within the lower support tray for guiding the corresponding cartridge to an upright orientation; and b) the step of lowering the stabilizing upper tray onto the cartridges supported within the lower support tray includes the step of engaging the upper rim of each cartridge with the rim-engaging surface of a corresponding port for guiding the cartridges into an upright orientation as the stabilizing upper tray is lowered onto the cartridges.

11. A method for converting a cartridge carrier tray into an upper stabilizing support tray, the cartridge carrier tray having an upper face, an opposing lower face, and a patterned array of cartridge holding locations formed therein and adapted to support cylindrical cartridges of a predetermined outer diameter, each cartridge holding location including a first collar extending from the upper face, a second collar extending from the lower face, and an axial through-hole extending concentrically through the first collar and second collar, the first collar of each cartridge holding location having a counterbore hole extending therein for receiving the base of a cartridge, the counterbore hole being concentric with, and communicating with, the axial through-hole, and the counterbore hole having an internal diameter proximate to, but greater than, the predetermined outer diameter of the cylindrical cartridges, the method comprising the steps of:

a) removing the second collar from each of the cartridge holding locations to provide an essentially planar lower face on the cartridge carrier tray; and b) forming inwardly-tapering needle-engaging bevels at each cartridge holding location, extending from the lower face of the oil cartridge carrier tray into each axial through-hole, the needle-engaging bevels being adapted to guide a fluid injection needle into the axial through-hole.

12. The method recited by claim 11 wherein each first collar includes a rim, and wherein the method includes the further step of forming inwardly-tapering rim-engaging bevels at each cartridge holding location, extending from the rim of each first collar generally toward the counterbore thereof, the rim-engaging bevels being adapted to guide an upper end of a cartridge into aligned engagement with the first collar.

13. The method recited by claim 11 including the step of flipping the converted cartridge carrier tray wherein the upper face of the cartridge carrier tray faces downward toward the cartridges, and wherein the lower face of the cartridge carrier tray faces upward.

* * * * *